United States Patent [19]

Trautmann et al.

[11] Patent Number: 5,005,250

[45] Date of Patent: Apr. 9, 1991

[54] GLASS SHEET CLEANING APPARATUS

[75] Inventors: Hugh M. Trautmann, Renfrew; H. Dale Shaner, Ellwood City, both of Pa.

[73] Assignee: Billco Manufacturing, Inc., Zelienople, Pa.

[21] Appl. No.: 361,449

[22] Filed: Jun. 5, 1989

[51] Int. Cl.[5] ..... F26B 15/00

[52] U.S. Cl. ..... 15/309.2; 15/316.1; 34/107

[58] Field of Search ..... 15/306 R, 306 B, 316 R; 34/107

[56] References Cited

U.S. PATENT DOCUMENTS

| | | | |
|---|---|---|---|
| 3,805,317 | 4/1974 | Dickinson | 15/316 R X |
| 4,198,725 | 4/1980 | Trutzschler | 15/316 R X |
| 4,667,419 | 5/1987 | Bovone | 15/306 B X |
| 4,702,017 | 10/1987 | Lenhardt | 15/306 B X |
| 4,727,614 | 3/1988 | Swistun | 15/306 B X |

*Primary Examiner*—Chris K. Moore

*Attorney, Agent, or Firm*—George C. Atwell

[57] ABSTRACT

In stationary equipment including a system for successively conveying curved glass sheets in a linear horizontal pathway through washing and rinsing zones, and than a drying zone, upper and lower air knife assemblies are utilized in the drying zone for simultaneously directing pressurized air streams on the opposite broad surfaces of the glass sheets to effect drying action. Each air knife assembly comprises an elongated bendable casing formed into a plenum disposed transverse to the pathway, with each plenum having a longitudinally extending slot serving as an orifice for emitting the air stream against the glass surface. The slot is defined by parallel spaced flexible strips sealed in longitudinal disposition on the casing. The strips, with the casing to which they are sealed, are adapted to be selectively adjustably shaped to generally conform to various glass sheet configurations. Conveying successive curved glass sheets through the drying zone is accomplished by continuously advancing spaced-apart cord-like belts supporting the sheets for movement along the pathway and preferably between the upper and lower air knife assemblies.

22 Claims, 7 Drawing Sheets

GLASS SHEET CLEANING APPARATUS

BACKGROUND OF THE INVENTION

This invention relates generally to the cleaning of glass sheets in apparatus wherein glass sheets are successively transported by a conveyor system through washing and drying zones, and it more particularly pertains to such apparatus particularly designed for cleaning bent or curved sheets or plates of glass.

It is common industrial practice to clean substantially large sheets of glass by providing equipment including a conveyor system that continuously moves successive glass sheets first through an enclosed tunnel-like washing and rinsing zone and then through a drying zone. The degree of required cleanliness determines the complexity of the equipment utilized in the washing and rinsing operation. A relatively simple water flushing and brushing process may be used where the glass sheets need only be generally visibly clean. Absence of finger marks, streaks, or spots on the sheets may require more intensive brushing and use of a heated detergent solution prior to rinsing. Greater degrees of cleanliness may be required where the glass sheets are intended for insulating, laminating, silvering, or vacuum coating processes, and for such needs, chemical-free or even clinical cleanliness can be accomplished by the provision of specialized brushing equipment, repetition of steps in the washing process, and more thorough or repeated rinsing.

It is typical, following the washing and rinsing steps, to convey the glass sheets through a drying zone where rinse water is removed such that the sheets are dispensed from the conveyor in a perfectly dry condition for packing or a subsequent manufacturing operation. In some relatively low-efficiency glass waterdryer equipment, the glass sheets are dried by application of heated rinse water which is allowed to evaporate from the glass surface. This method typically results in water spotting and does not accomplish effective drying of the glass edges. More advanced systems virtually eliminate water spotting by accomplishing the drying operation through the use of a high-pressure air stream applied to the glass sheet surfaces. Each glass sheet, supported by the conveyor, is moved past an adjacent slot elongated to reach across the entire sheet, and the high-intensity blower-driven air stream is emitted close to the sheet surface at a predetermined angle to peel the water and any other impurities from the glass surface and blow them rearwardly as the glass sheet progresses forwardly on the conveyor. The structure which distributes the air stream against the glass, including the aforementioned slot, is referred to in the industry as an air knife. A plurality of spaced-apart air knives may be utilized whereby the glass sheet, as it progresses on the conveyor, may be subjected to successive high-intensity air stream applications to effect thorough drying of the sheet.

The typical air knife assembly includes an elongated box-like enclosed chamber or plenum disposed to extend transverse to the pathway of the conveyor on which the successive glass sheets are supported. From a remote stationary heavy-duty blower, a continuous air flow is conducted into the plenum through an interconnecting conduit, and the air flow is distributed from the plenum through a longitudinal slot as a high velocity curtain-like air stream striking the glass surface on a line extending entirely across the sheet.

For the cleaning of curved glass sheets which present one concave surface and an opposite convex surface, it is common practice to provide a conveyor system adapted to support the sheets from beneath, for travel in a horizontal pathway, with the sheets oriented with the axis of their curvature parallel to the pathway. For such specialized cleaning equipment, air knives have been developed where the structure defining the air stream distribution slot has a rigid sweeping curvature so that the slot is positioned closely parallel to the curved glass sheet surface conveyed past the slot during the drying operation. Such equipment has proven very effective for its desired purpose but is limited in its application to the cleaning only of curved glass sheets to which the air knives are shaped to conform. Such machinery has been adapted to permit conversion by substitution of appropriately shaped air knives consistent with the particular curvature of glass sheets to be subjected to a cleaning operation. Such conversion, however, necessitates the special construction of differently shaped air knives, each shape suitable only for drying glass sheets of a particular curvature. This involves high manufacturing costs and the additional operating expenses associated with extensive conversion down time.

SUMMARY OF THE INVENTION

The present invention comprehends the provision of apparatus in the form of stationary equipment for cleaning curved glass sheets by conveying identical successive sheets through washing and rinsing zones and then through a drying zone where pressurized air streams are directed against the entire sheet to effect a thorough drying operation. The curved glass sheets are preferably conveyed through the successive cleaning zones in a linear horizontal pathway, with the sheets being supported on their underside by the conveyor and the sheets preferably being oriented such that their major symmetrical curvature is parallel to the direction of travel of the conveyor.

The specific apparatus of the invention for achieving the drying action includes air knife means disposed adjacent the pathway of travel of the conveyor which directs a continuous air stream against the broad surfaces of the sheet in a pattern generally transverse to the direction of sheet movement. The air knife means comprises an elongated plenum constructed from a flexible casing opened along its length and having the edges defining the opening sealably secured, each to one of a pair of elongated parallel spaced flexible strips. The space defined between the strips constitutes a longitudinal orifice or slot for emitting a continuous pressurized air stream. The facing edges of the strips, defining the longitudinal orifice, are preferably appropriately angled to effect the direction of air stream emission. The entire air knife, including the casing and the strips sealed thereto, is adapted to be adjusted and fixed in a predetermined curvature to conform it in uniform spaced relation to the broad surface of the curved glass sheet which is then conveyed past the slot to effect the drying operation.

Separate upper and lower air knife assemblies are utilized in the apparatus, each fixedly mounted and conformably curved relative to the adjacent glass surface against which its air stream is directed. For providing the air flow to the plenum and thence creating the air stream from the slot of the air knife, a remotely located stationary heavy-duty blower is utilized and its output side is connected to conduit means communicating with the plenum. In its preferred form, the conduit from the blower to the plenum is flexible tubing of the same general structure and diameter as the plenum body and constitutes two separate conduits coming from the output side of the blower with each extending to join the plenum at one of its ends whereby the longitudinal slot is the only available exit for the air flow and the rate of distribution along the length of the slot is thereby maintained uniformly constant.

The air knife apparatus of the present invention further includes rigid slot bridging means substantially contained within the tubular member for maintaining the integrity of the assembly, and adjustable mounting means permitting reshaping of the air knife body, in accordance with a desired contour or curvature, and locking the air knife body in the reshaped orientation. The air knife is also preferably provided with means to enable it to be selectively tilted as a unit and means to shift it angularly as a unit on a vertical pivot line.

The apparatus of the present invention also comprehends the provision of a conveyor utilizing spaced-apart cordlike belts adapted to advance in unison partially as a glass sheet supporting section in a horizontal plane. The belts extend between upper and lower air knife assemblies of the type heretofore described, with the distance between the belts being laterally adjustable to accommodate various sizes of curved glass sheets to be cleaned.

In accordance with the foregoing general summary, it is a primary object of the present invention to provide, in curved sheet glass cleaning apparatus, air knife structure capable of being repeatedly reshaped or recurved without requiring its removal from its general operative disposition.

It is a further objective of the present invention to provide a means of conveying a curved glass sheet in which the sheet has constant conveyor support while it is moved the full length of the drying zone and through the space between upper and lower air knife assemblies.

It is a still further object of the present invention to provide, in curved glass sheet cleaning apparatus, an air knife structure that can be repeatedly reshaped to conform to the general curvature of glass sheets to be cleaned, along with means for selectively adjusting the tilt of the air knife or the angle of its line of extension across the pathway in which glass sheets are conveyed for accomplishing a drying operation thereon.

Other structural and functional features of the invention will become apparent from the ensuing detailed description of the presently preferred embodiment of the invention when read in reference to the accompanying drawings.

DETAILED DESCRIPTION OF THE PREFERRED EMBODIMENT

1. Structure

Figure 1:
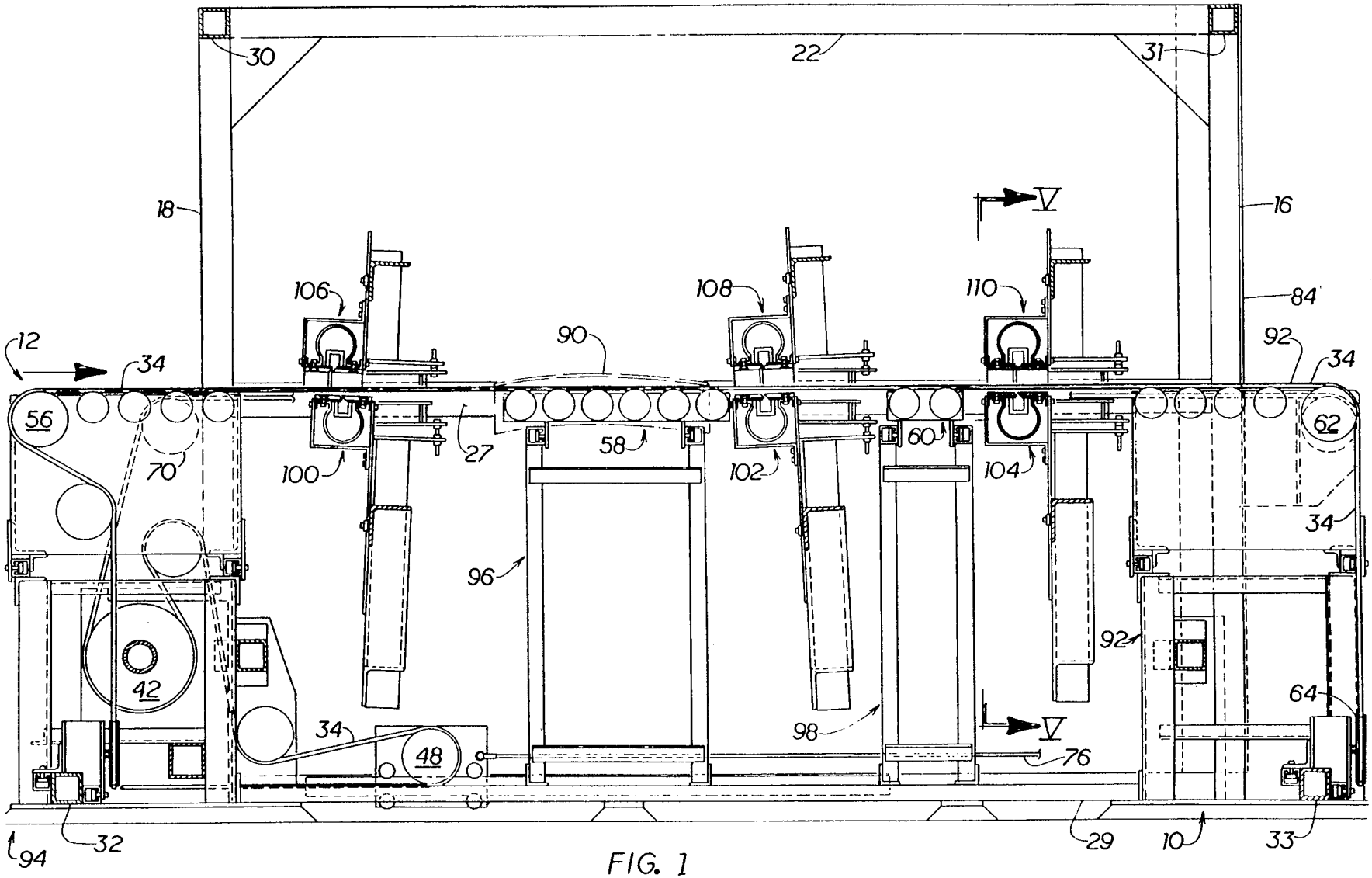
FIG. 1 is a side elevational view of structure constituting drying zone apparatus of the present invention.
Figure 3:
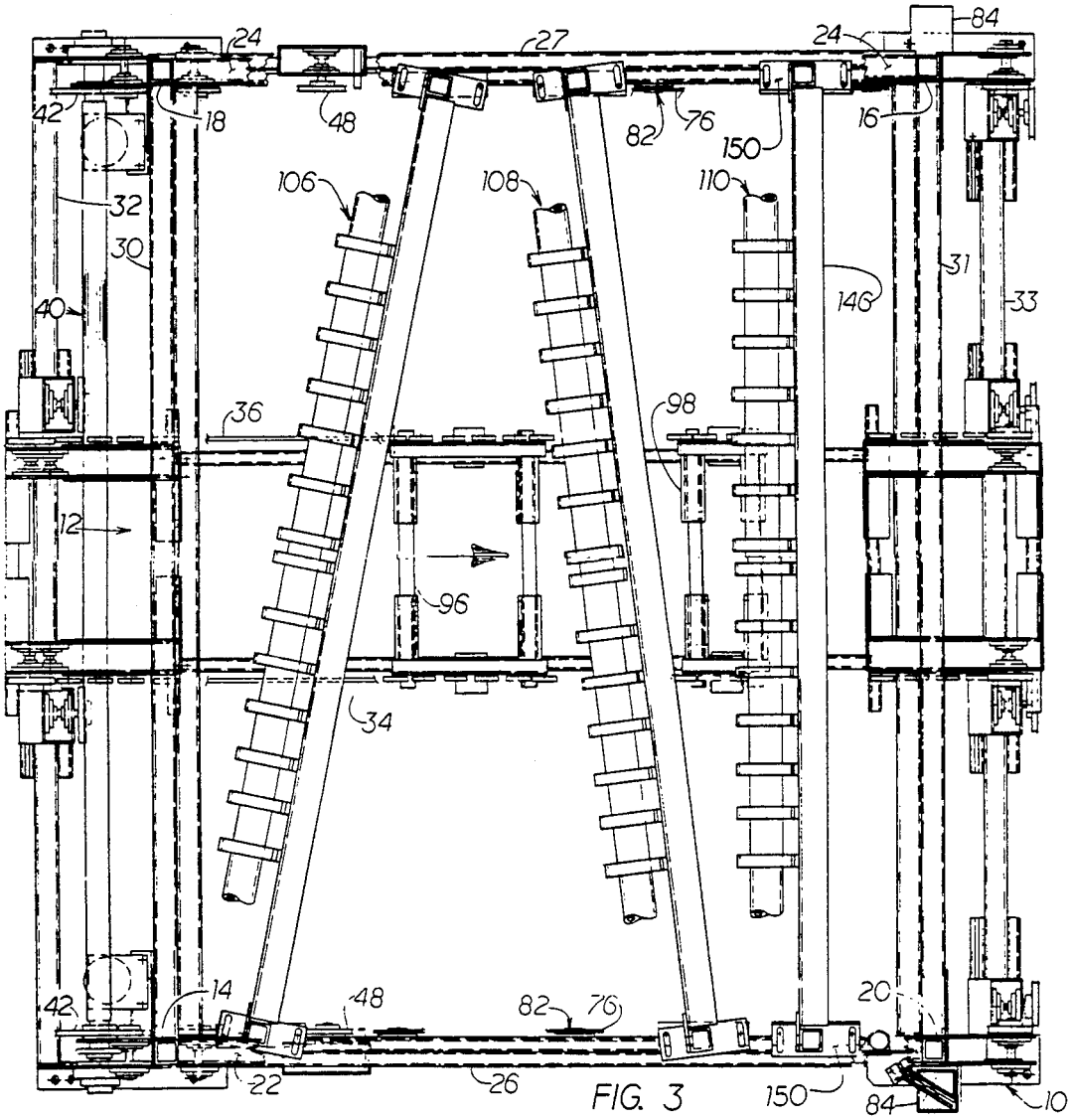
FIG. 3 is a top plan view of the structure first shown in FIG. 1 but, here, showing certain components repositioned relative to that which is shown in FIG. 1.
Figure 4:
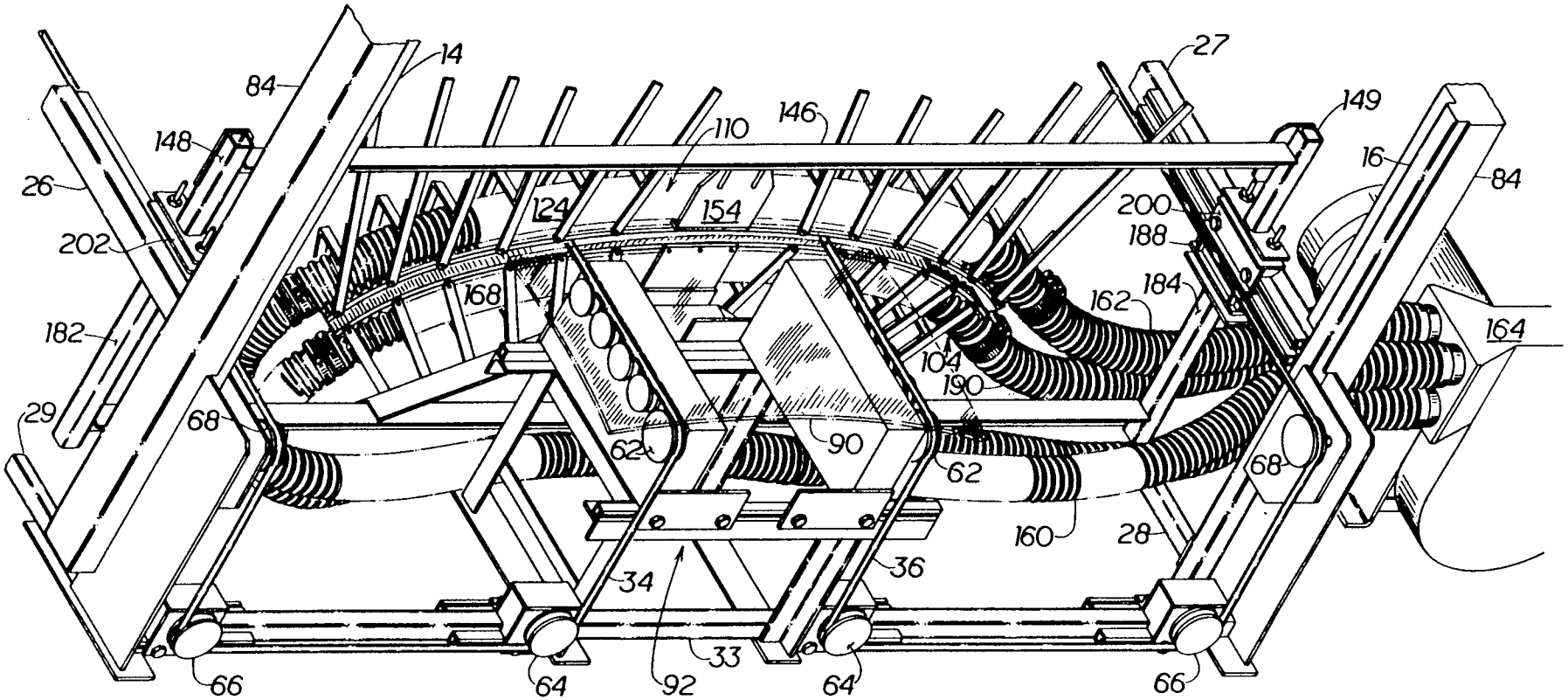
FIG. 4 is an isometric view illustrating the output end of the drying zone apparatus of the present invention.

FIG. 1 illustrates structure utilized in a system for effecting a drying operation on substantially large glass sheets. The structure includes a support frame identified generally by the numeral 10, and a conveyor system 12. The components of the support frame 10 are best shown in FIGS. 1, 3, and 4. The support frame 10 has a rectilinear configuration with fixed vertically-extending pillars 14, 16, 18, and 20 interconnected by upper longitudinally-extending beams 22 and 24, intermediate longitudinally-extending beams 26 and 27, and floor-level beams 28 and 29. The rectilinear form of the support frame 10 further includes upper cross-beams 30 and 31, and floor-level cross-beams 32 and 33. In addition to the major fixed frame components of the support frame 10 heretofore described, there are other adjunct support members which will be mentioned as this description continues.

Figure 2:
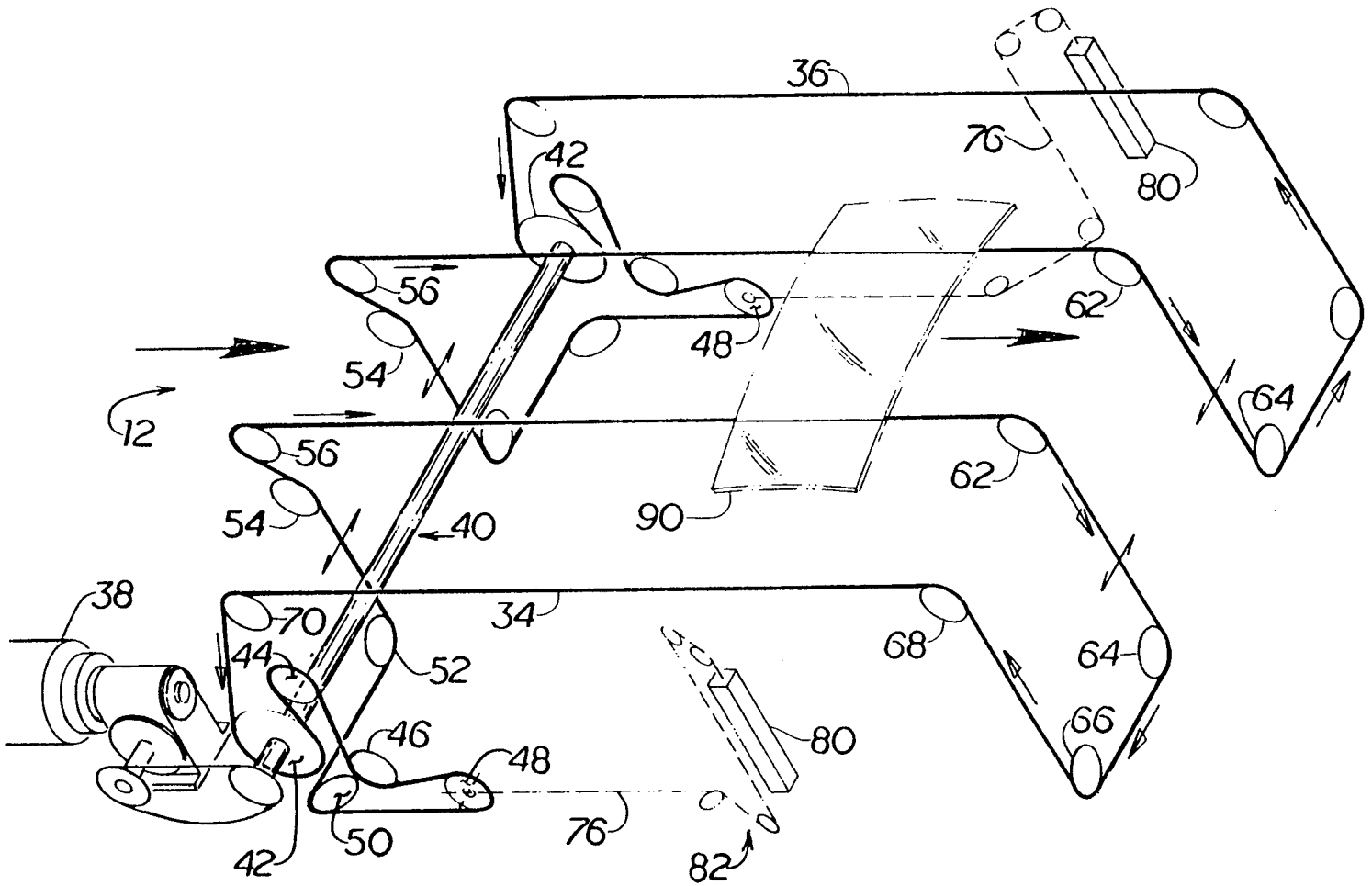
FIG. 2 is a schematic representation of the conveyor system utilized in the structure first shown in FIG. 1.

The conveyor system 12 is positioned to extend longitudinally and centrally through the support frame 10, and preferably comprises separate pulley-supported, driven endless belts 34 and 36 as best shown in FIG. 2. FIG. 2 also shows that both belts 34 and 36 are driven by a motor 38 which is arranged to rotatively drive an elongated horizontally-disposed and laterally-extending shaft—torque tube assembly 40.

With specific reference to the belt 34 illustrated in FIG. 2, it will be seen that it is carried about a drive pulley 42 and extends upwardly and over an idler pulley 44 and thence downwardly and about the underside of an idler pulley 46. From the idler pulley 46, the belt 34 extends to and wraps around a longitudinally slidable pulley 48 which is adapted to maintain tension on the belt 34. The idler pulleys 44, 46, and 48 are rotatably mounted on respective horizontal shafts, each having its axis parallel to the axis of the torque tube assembly 40. From the idler pulley 48, the belt 34 extends to and about an idler pulley 50 mounted on a vertical shaft to direct the belt 34 inwardly to an idler pulley 52, the axis of which is horizontal and longitudinal relative to the support frame 10. From the pulley 52, the belt 34 extends upwardly and over an idler pulley 54 and thence about an idler pulley 56. Each of the idler pulleys 54 and 56 has a horizontal axis disposed laterally relative to the support frame 10. From the idler pulley 56, the belt 34 extends longitudinally through the support frame 10 over horizontal pulley assemblies 58 and 60 (FIG. 1) and thence to an idler pulley 62 which directs the belt downwardly to an idler pulley 64. The idler pulley 64 corresponds in purpose to the idler pulley 52 and directs the belt laterally to an idler pulley 66 which, in turn, directs the belt upwardly and over an idler pulley 68. From the pulley 68, the belt 34 extends along the outer periphery of the support frame 10 and over and about idler pulley 70 which directs the belt downwardly and back to the drive pulley 42.

FIG. 2 also illustrates the tensioning system for the belt 34 which includes a flexible cable 76 having a first end connected to the shaft of the pulley 48 and its other end secured to a suspended weight 80. The cable 76 extends through a series of guide pulleys, generally identified as 82, which thread it longitudinally along the lower periphery of the support frame 10 and then upwardly within a box-like enclosure 84 on pillar 16 (FIG. 1) wherein the weight 80 is suspended (by means not shown) to maintain constant tension on the slidably mounted pulley 48 to keep the belt 34 constantly taut.

With respect to the belt 36 shown in FIG. 2, the disposition of the belt and its pulley arrangement is a mirror image of that heretofore described with reference to belt 34. Hence, not all of the pulleys which support belt 36 are specifically given numeral designations, and a few that are, as hereafter identified, are given the same numeral designation as the respective counterpart components in the belt support and drive arrangement heretofore described with reference to belt 34. For example, the belt 36 has its own drive pulley 42 rotatably mounted on the shaft—torque tube assembly 40.

Glass sheets to be subjected to a drying operation in the described apparatus are placed, one after another, on and across the belts 34 and 36 on the upperside of spaced-apart pulleys 56 whereby each sheet is carried in a linear pathway and in a horizontal disposition through the drying zone as shown by glass sheet 90 in FIG. 2.

The central part or supporting length of the conveyor system 12, which is from the laterally-spaced pulleys 56 to laterally-spaced pulleys 62, is adapted to be laterally adjustable to accommodate different sizes of glass sheets. More specifically, as shown in FIG. 4, which illustrates the outlet end of the drying zone apparatus shown in FIG. 1, a central conveyor support structure denoted generally by numeral 92 is adapted to be laterally slidably adjusted to decrease or increase the distance between the belts 34 and 36 in the central area of the drying zone. The purpose of such adjustment is to enable the equipment to be quickly changed to accommodate a run of identical glass sheets of a given size. To enable the described adjustment, the support structure 94 (FIG. 1), at the input end of the drying zone, is adapted to be similarly laterally selectively adjusted, as are intermediate support stands 96 and 98 on which are mounted pulley assemblies 58 and 60. Such adjustment, when carried out, obviously changes the distance between pulleys 64 and 66 and also between pulleys 50 and 52 whereby the degree of extension or retraction of each belt 34 and 36 is also effected. The slidably mounted pulley 48, for each belt, automatically repositions itself as a function of the aforementioned adjustment procedure such that each belt 34 and 36 is always maintained in snug operative contact with its supporting pulleys.

As illustrated in FIG. 1, the apparatus of the present invention includes air knife means, preferably comprising separate air knife assemblies 100, 102, 104, 106, 108, and 110. The provisions of air knife means enables the use of a pressurized air stream to effectively "peel" rinse water from both broad surfaces and all the edges of prewashed and rinsed glass sheets whereby glass sheets conveyed through the drying zone established by the disclosed apparatus are delivered therefrom in a fully dried condition.

Figure 5:
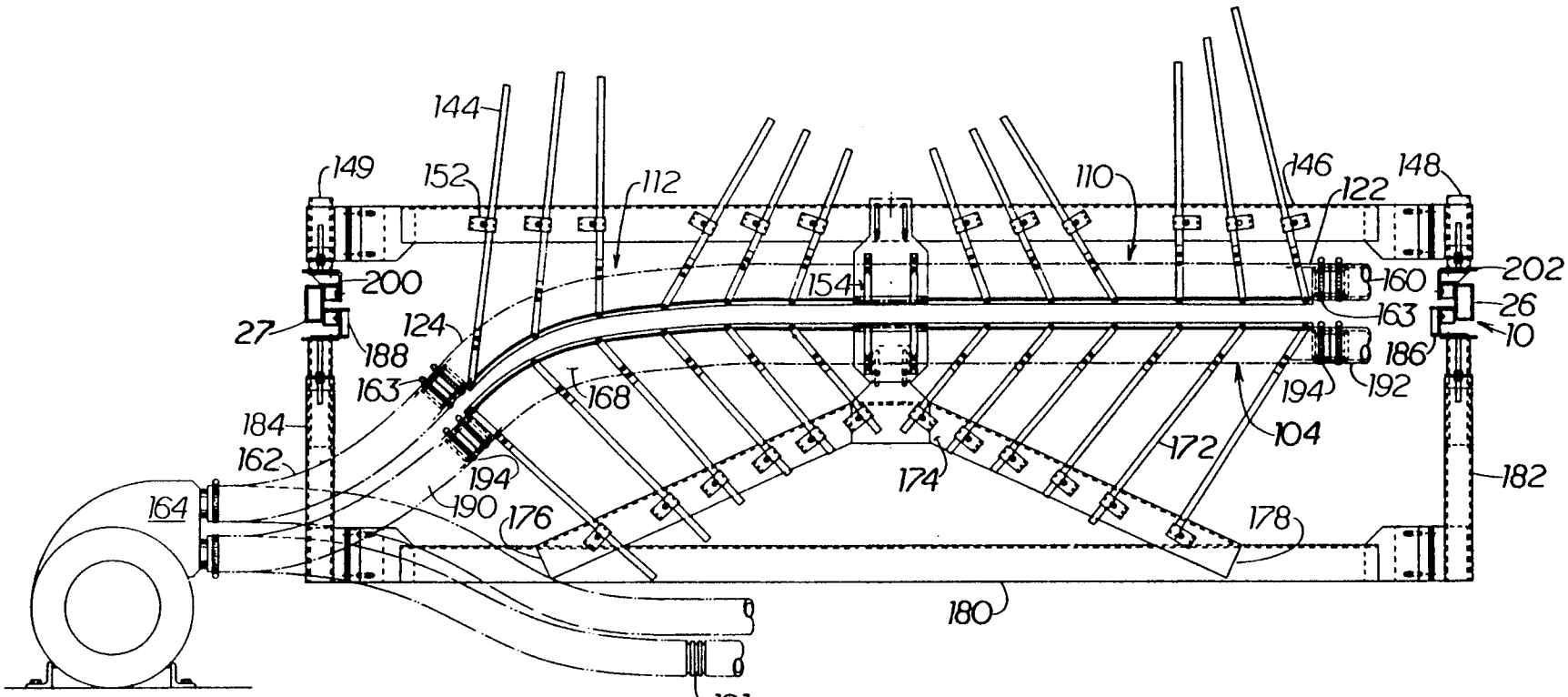
FIG. 5 is a view in vertical section taken generally along lines V—V of FIG. 1.
Figure 6:
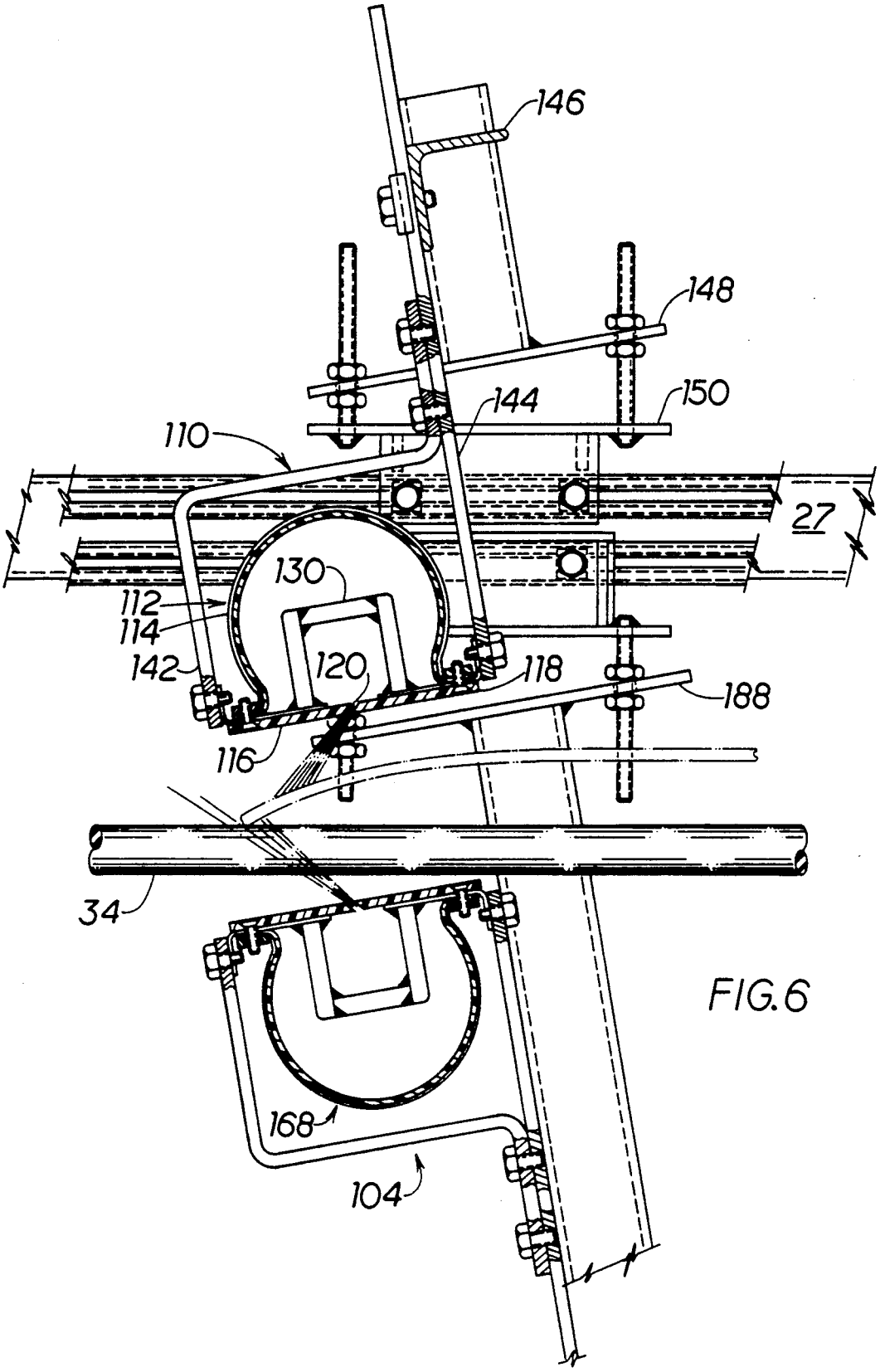
FIG. 6 is a fragmentary enlarged view in vertical section taken from the structure first shown in FIG. 1.
Figure 8:
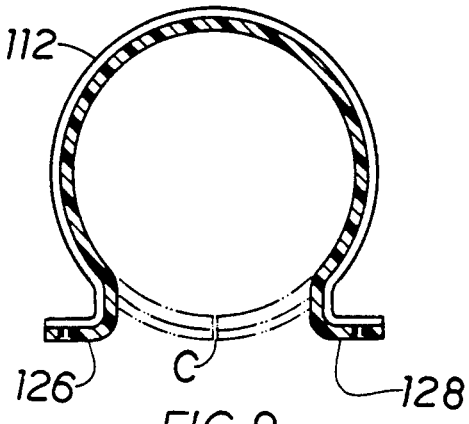
FIG. 8 is a view in enlarged vertical section of a component of the air knife structure shown in FIG. 7.

The air knife assembly 110, shown in FIG. 6, is generally representative of the other air knife assemblies in the apparatus, includes an air distribution plenum identified generally by numeral 112 having a casing 114 with a flat long side or face constituting a pair of strips 116 and 118 defining between them a slot 120. As shown in FIG. 5, the plenum 112 is elongated whereby its casing 114 extends from one plenum end 122 to its other end 124. The strips 116 and 118 are also elongated, extending the full length of the casing 114. The plenum 112 is preferably formed by utilizing, for the casing 114, a length of commercially available, corrugated, cord-reinforced tubing. Such tubing, having a vinyl exterior and ring-like corrugations 121 is similar to a corrugated plastic vacuum cleaner hose but of a significantly larger diameter (preferably 4-inch wide diameter). An appropriate length of the tubing is split along its length, as indicated in FIG. 8, and the resulting edges defining the split are reformed outwardly to provide longitudinal flanges 126 and 128.

Figure 6A:
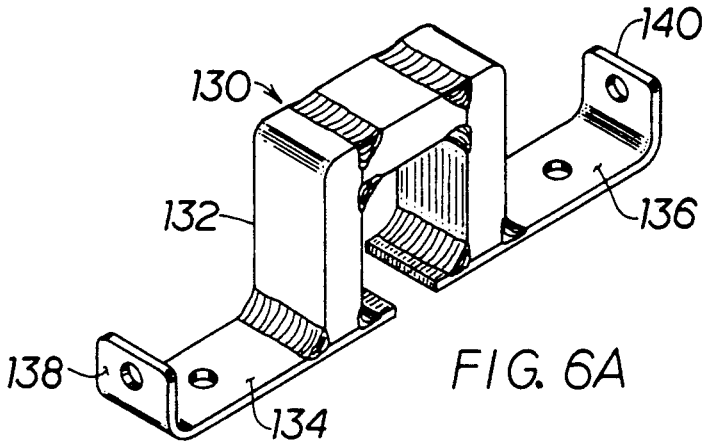
FIG. 6A is an isometric illustration of an element of the invention first shown in FIG. 6 and shown enlarged as compared to FIG. 6.
Figure 7:
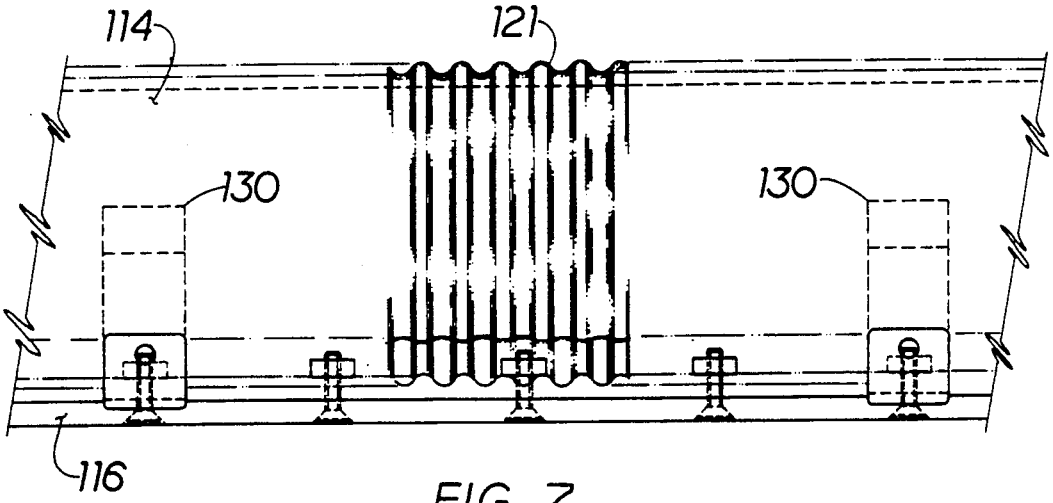
FIG. 7 is a fragmentary enlarged side elevational view of air knife structure in accordance with the present invention.

The strips 116 and 118 are cut from a substantially thick sheet (preferably 25 inches) of semi-rigid flexible plastic material. Polyethylene having an ultra-high molecular weight has been successfully used for this purpose. The strips 116 and 118 are respectively sealably fixed, along one long edge thereof, to the underside of the respective flanges 126 and 128. A plurality of internal rigid bridging members 130, one of which is shown separately in FIG. 6A, are equidistantly spaced within the casing 114, as shown in FIG. 7. Each bridging member 130 has a central rigid U-shaped portion 132 (FIG. 6A) and integral oppositely-extending arms 134 and 136, terminating in respective upwardly turned end portions 138 and 140. As shown in FIG. 6, the bridging member 130 bridges the slot 120, and its respective legs 134 and 136 are sealably captured between the respective strips 116 and 118 and the casing flanges 126 and 128. The ends 138 and 140 provide respective connecting points for a rigid support bracket member 142 and rod 144.

The air knife assembly 110 further includes an angle iron member 146, shown in its full length in FIG. 5, which serves as a mounting base for the plenum 112. The angle iron member 146 is connected, at each of its ends, to respective tiltable pedestals 148 and 149, adjustably fastened respectively to beams 26 and 27 (FIG. 6). Along the length of the angle iron support member 146 (FIG. 5), each of the rods 144, oriented vertically, is slidably secured by its own releasable clamp 152. At an intermediate point along its length, the plenum 112 has a fixed rigid mounting plate 154 (FIG. 5) secured at one end to the angle iron member 146 and at its other end to the flanges of the casing 114 and the contiguous strip 118 (FIG. 6).

The plenum 112, at its ends 122 and 124, is joined to conduit or tubing sections 160 and 162 (FIG. 5), each of which is preferably the same type of tubing used in the formation of the casing 114. The conduits 160 and 162 may each be joined to the plenum casing by provision of an internal rigid collar which extends across the point of jointure and the provision of outer clamping bands 163 to complete the connection. Each of the conduits 160 and 162 has an end projecting outwardly from the support frame 10 which is connected to the output side of a heavy-duty blower assembly 164, (FIGS. 4 and 5).

FIGS. 4, 5, and 6 show the structure forming or relating to the air knife assembly 104 which is disposed directly beneath and coextension with air knife assembly 110. The air knife assembly 104 includes a plenum 168 which is substantially identical in construction to the plenum 112 in the air knife assembly 110. The plenum 168 has its own set of support rods 172, identical in form and function to the rods 144. The rods 172 extend upwardly, as shown in FIG. 5, from a rigid member 174 shaped as an inverted "V" and having opposite ends 176 and 178 fixedly secured to an angle iron member 180. At each of its ends, the angle iron member 180 is rigidly joined to upwardly-projecting arms 182 and 184 which are rigidly attached to respective hanger members 186 and 188 tiltably suspended from the respective beams 28 and 26. The plenum 168 is clamped in flow communication with flexible tubular members 190 and 192 by means of clamping bands 194. As shown in FIG. 4, the conduits 190 and 192 are in flow communication with the output side of blower 164.

II. Function

The apparatus shown in FIG. 1 constitutes the drying zone to which glass sheets are successively delivered in a wet condition from equipment (not shown) which thoroughly washes and rinses the sheets. The washing and rinsing equipment is provided with its own separate conveyor system having a horizontal bed at the same level as that of the conveyor system 12 whereby each wet sheet is smoothly transferred to the drying apparatus shown in FIG. 1. Each sheet moves through the drying apparatus in a linear horizontal pathway, from left to right as viewed in FIG. 1, supported on the moving belts 34 and 36 as indicated in FIG. 2. As the sheet progresses through the drying zone established by the apparatus, it is subjected to high-intensity rearwardly-angled air streams emitted from the air knife assemblies spaced along its route of travel.

The air stream impacting against the glass surface first creates a dynamic barrier which breaks the water film adherence to the surface and creates a curtain-like barrier to halt the forward progress of the water film. Then, the force of the rearwardly dissipating air stream imparts energy to the arrested water accumulation whereby the water is propelled rearwardly as the glass sheet continues its forward progression on the conveyor.

Each air knife assembly of the present invention, in addition to being reshapable along its length to conformably curve the plenum face to a desired configuration, is also adapted for a limited tilting or rolling adjustment on an axis parallel to the plenum. Referring again to air knife assembly 110, it will be seen that this is accomplished by the manner in which the pedestals 148 and 149 and the hangers 186 and 188 are adjustably secured to the respective support frame beams 26 and 27. Moreover, the plenum may be selectively shifted a limited distance by shifting its angle of orientation relative to the pathway of conveyor travel. More specifically, the elongated plenum, whether above or below the conveyor travel pathway, always extends transversely, at an angle to a vertical plane taken centrally through the pathway. The mounting arrangement of the plenum includes means for a limited adjustment in the angular position of its extension relative to the described vertical plane. The present means of accomplishing such adjustment is shown in FIGS. 3, 4, and 6.

As shown in FIGS. 4 and 6, the pedestal 148 is carried on a slidable plate member 150. The plate member 150 may be selectively repositioned along the beam 27. A similar slidable arrangement is provided for the hanger member 188. FIG. 4 shows that the pedestal 149 and hanger member 186, are slidably arranged on the beam 27. FIG. 3 shows that the plate member 150 is appropriately slotted to accommodate the repositioning of the angle iron support member 146 whereby the air knife assembly 110 can be angularly shifted relative to the conveyor pathway to a position, for example, as shown in FIG. 3 for the air knife assembly 108 or that of the air knife assembly 106.

With reference to the slidable arrangement for supporting the aforedescribed pedestals and hanger members as illustrated in FIG. 6, and the slidable arrangement for the journal support frames of the pulleys 64, shown in FIG. 4, the structure to accomplish the slidable function can be interlocking channel tracks which are commercially available and sold under the tradename "Unistrut".

With reference to the selective reshaping of the plenum structure of an air knife assembly to conform it to a particular glass sheet configuration, it should be noted that the plenum structure of air knife 100 (which is representative of all the other air knife assemblies shown) is reshaped first by appropriate loosening of the clamps 152 as shown in FIG. 5., followed by proper manipulation of the rods 114 whereby the bending action occurs in the strips 116 and 118, with the flexible casing 114 flexibly conforming to the bending of the strips. The clamps 152 are then tightened to hold the rods 144 in their respective new positions. Imparting the bending action to the strips, rather than the centerline of the casing, assures that the resultant stress or strain maintains the strips in tension rather than compression to thereby avoid buckling or distortion of the strips which would destroy the continuity of the slot 120.

Although the apparatus shown in FIG. 1 utilizes six separate air knife assemblies arranged in upper and lower pairs, the actual number required in any given installation depends upon such variables as the size and shape of the glass sheets being processed and the end use requirements of a particular installation. In some installations, only one set of upper and lower air knife assemblies may be required whereas a spacing of a plurality of air knife assemblies along the route of travel can assure absolute dryness of the emerging sheets with respect to both major surfaces and the edges as well. A glass sheet passing through the first set of upper and lower air knives loses the bulk of its rinse water coating but water droplets missed by the first air knife sweep, particularly along the sheet edges, will streak rearwardly over the upper and lower broad surfaces of the sheet and be picked up and "peeled" off by the next set of air knives disposed downstream in the sheet travel pathway.

The effective operation of an air knife in achieving effective drying of glass sheets and glass cleaning equipment requires that the elongated orifice or slot through which the air stream is emitted be at a close uniform distance from the sheet's surface at any point across the sheet. Hence, the versatility of such equipment is significantly enhanced by the provision, in accordance with this invention, of an air knife assembly capable of preadjustment to conform the orientation of the air stream emitting slot to the configuration of glass sheets to be cleaned in a mass production operation. The adjustable air knife assembly is compatible for perfectly flat sheets while being also adaptable to curved glass sheets of the type now commonly used for vehicle windshields and rear windows.

It is contemplated that the adjustable air knife assemblies of the present invention may be employed with known forms of sheet material conveyors other than the conveyor system 12 herein disclosed, including conveyor systems having spaced rollers carried on rotating transversely-extending shafts, in which the sheet would be passed between upper and lower air knife assemblies without continuous sheet support in the area between the adjacent upper and lower air knife slots that is provided by the conveyor system 12. There are, however, certain distinctive advantages to the provision of the cord-like belts of the disclosed conveyor system particularly as utilized in the embodiment of the invention herein described.

The use of driven tensioned cord-like belts for sheet conveyance is known in the industry. They have the advantage of an extremely narrow line of contact on the underside of the sheet, thus exposing more of the sheet surface for drying as compared to the broader contact expanse of other types of conveyors. The use of plural parallel sheet-supporting cord-like belts, as in the disclosed invention embodiment, with the belts extending as a continuous track through and between upper and lower air knife assemblies, is a unique feature of the present invention. This feature provides significantly improved drying of curved glass sheets, particularly where the sheet has a long sweeping curve or is compoundedly curved.

Maintaining a sheet's level advancement through the drying pathway may not be practical with other types of known sheet conveyor systems, but supporting it on spaced-apart cord-like belts as it is carried between the upper and lower air knife assemblies, as shown in FIG. 6, has proven extremely satisfactory. Where, in the configuration of a particular glass sheet, the leading or rearward edge of the sheet is the termination of a curve, maintaining a constant distance between the face of the air knife and the glass sheet surface obviously is not possible, however, it is the unusual glass sheet configuration which best utilizes the total capabilites of the apparatus of this invention, particularly the full-support belt concept.

The air knife assemblies are preadjusted to conform each as closely as reasonably possible to the particular configuration of the sheet which will move past them. The central support sections of the belts 34 and 36 are laterally adjusted in their spacing relative to each other to assure a balanced orientation of the sheets to be dried. The sequential effect of excessive banks or pairs of air knife assemblies along the continuous supporting length of the conveyor system assures completion of a thorough drying operation of the sheets moved through the apparatus.

The lateral adjustment capability of the conveyor system 12, allowing selective changing of the distance between the glass-supporting area of the belts 34 and 36, also permits non-parallel disposition of the supporting section of the belts. The laterally slidable support structure at the input end of the conveyor system 12 can be adjusted whereby the distance between the spaced-apart pulleys 56 is slightly greater or less than the distance between the pulleys 62 at the output end of the system. By such an arrangement, the line of contact of each belt 34 and 36 on the underside of a glass sheet being conveyed through the pathway of travel will gradually shift laterally in a direction depending on whether the supporting sections of the belts 34 and 36 tend to diverge or converge towards the system's output end. This change in the line of contact on the undersurface of the glass sheet as it progresses through the pathway assures that the entire undersurface will have been fully directly subjected to the direct contact of an air stream during the sheet's travel along the full length of the conveyor pathway.

It is anticipated that modifications or variations may hereafter be made which depart from the specific structure illustrated with reference to the preferred embodiment in the accompanying drawings, and it is intended that all such modifications or equivalent variations be included within the scope of the appended claims.

We claim:

1. Apparatus for drying sheets of glass including conveyor means for moving a wet glass sheet, oriented with its broad surface facing generally vertically, in a linear pathway, and air knife means disposed adjacent the pathway and having means defining an elongated slot for directing a continuous air stream against at least one broad surface of the sheet in a pattern transverse to the direction of sheet movement, characterized by the slot being adjustable along its length to a straight disposition consistent with a flat glass sheet and to a predetermined curvature generally conforming it to a curved configuration in a glass sheet.

2. The apparatus of claim 1 further characterized by the air knife means including an elongated plenum for conducting a pressurized air flow to the slot.

3. The apparatus of claim 2 further characterized by the plenum being formed from flexible tubing.

4. The apparatus of claim 1, further characterized by the air knife means including a plenum which is at least partially arcuate in cross-section.

5. The apparatus of claim 1 further characterized by the air knife means including a pair of elongated flat flexible strips oriented parallel to each other in spaced-edge relation to define the slot.

6. The apparatus of claim 1 further characterized by the air knife means comprising a flexible plenum, the slot disposed along the length of the plenum, and the plenum being in flow communication with a means for generating a pressurized air flow.

7. The apparatus of claim 1 further characterized by the air knife means comprising an elongated flexible plenum, the slot disposed along the length of the plenum, and the plenum having a first end and a second end connected to receive a pressurized air flow.

8. The apparatus of claim 1 further characterized by the air knife means comprising flexible tubing split along its length, a pair of elongated flat strips separately secured to the edges of the split, and rigid bridging means contained within the tubing for maintaining the strips in relative parallel and spaced disposition to define the slot.

9. The apparatus of claim 8 further characterized by the strips being sealed to and along the respective tubing edges.

10. The apparatus of claim 1 further characterized by the air knife means including a first air knife assembly disposed above the pathway and a second air knife assembly disposed below the pathway.

11. The apparatus of claim 1 further characterized by a plurality of rods movably secured, in spaced relation to each other, to a frame member, the frame member extending in a generally horizontal disposition transverse to the pathway, the plenum disposed in spaced adjacency to the frame member, and each of the rods connected to the plenum.

12. The apparatus of claim 11 further characterized by the frame member being adapted for limited tilting on an axis coextensive with the frame member.

13. The apparatus of claim 1 further characterized by the air knife means including an elongated housing defining an air distribution chamber, the elongated slot constitutes a longitudinal opening from the chamber, and the housing is adapted for selective limited tilting relative to an axis coextensive with its length.

14. The apparatus of claim 1 further characterized by the means defining the slot being an elongated plenum which can be selectively reshaped by bending it about plural, spaced-apart and parallel axes which are transverse to the direction of the plenum's elongation.

15. The apparatus of claim 14 further characterized by the plenum having a flat face comprised of spaced-apart elongated strips, and the bent axes extending through and normal to the long dimension of the strips.

16. The apparatus of claim 14 further characterized by the plenum extending at an angle to a vertical plane taken centrally through the pathway, and means for selectively changing the angle of the plenum relative to the vertical plane.

17. Apparatus for cleaning sheets of glass including conveyor means for advancing a glass sheet, oriented with its broad surface facing vertically, along a linear pathway, and an air knife assembly disposed adjacent the pathway and having an elongated slot for directing a continuous air stream against at least one broad surface of the sheet in a pattern transverse to the direction of sheet movement, characterized by the conveyor means having a plurality of spaced coextensive parallel cords driven along the pathway and movably supporting the glass sheet along the full length of the pathway.

18. The apparatus of claim 17 further characterized by means selectively operative to vary the speed of the conveyor means.

19. The apparatus of claim 17 further characterized by the air knife means including upper and lower air knife assemblies, each having an outlet slot oriented generally toward the outlet slot of the other, and the cords extending generally horizontally between the outlet slots.

20. The apparatus of claim 17 further characterized by the cords each being endless and carried on a series of spaced-apart pulleys, and means for automatically maintaining a predetermined tension on the cords.

21. The apparatus of claim 17 further characterized by means to manually adjust the distance between adjacent cords extending through the pathway.

22. The apparatus of claim 17 further characterized by each cord being uniform and circular in cross-section.

* * * * *